United States Patent [19]

Greenquist

[11] 4,033,476

[45] July 5, 1977

[54] SIDE DOOR BIN WITH IMPROVED HINGE SUPPORT

[75] Inventor: Duane R. Greenquist, Beatrice, Nebr.

[73] Assignee: Hoover Ball and Bearing Company, Saline, Mich.

[22] Filed: Sept. 3, 1976

[21] Appl. No.: 720,147

[52] U.S. Cl. ..... 220/334; 220/342; 16/173; 16/128 R

[51] Int. Cl.[2] ..... B65D 43/14; B65D 51/04

[58] Field of Search ..... 222/556, 129; 16/128 R, 16/171, 172, 173; 220/334, 331, 342, 343, 344

[56] References Cited

UNITED STATES PATENTS

| | | | |
|---|---|---|---|
| 2,049,067 | 7/1936 | King et al. | 16/173 |
| 3,130,855 | 4/1964 | Gunn, Jr. | 220/334 |
| 3,651,537 | 3/1972 | Nichols | 220/334 |

*Primary Examiner*—George T. Hall
*Attorney, Agent, or Firm*—Olsen and Stephenson

[57] ABSTRACT

A bin for storing and transporting bulk material having a discharge opening located in one side wall and a door hingedly mounted on the side wall for movement to a closed position overlying the opening. A hinge is provided having horizontally disposed end pins on which the door is hung for up and down pivotal movement toward and away from the discharge opening. The construction of the hinge prevents the accumulation of contaminants and foreign matter around the door and enables the easy removal of the door from the bin.

5 Claims, 8 Drawing Figures

SIDE DOOR BIN WITH IMPROVED HINGE SUPPORT

BACKGROUND OF THE INVENTION

Side door discharge bins of the type shown in U.S. Pat. No. 2,648,428 have been extensively used for storing and transporting bulk material. In co-pending application, Ser. No. 535,573, filed Dec. 23, 1974, and assigned to the assignee of the present application, a bin is disclosed having an improved side door construction. In order to insure that a dust-tight seal exists between the door and the bin discharge opening, it is essential for reasons of sanitation and ease of door closing that the bulk material being handled and foreign matter such as dirt does not accumulate around the door thereby impeding the movement of the door or preventing a secure dust-tight seal between the door and the opening. The present invention provides a hinge construction for a side door bin which prevents the accumulation of foreign matter around the hinge and provides for easy attachment and removal of the door to and from the bin so that the bin and door can easily be cleaned and closed.

SUMMARY OF THE INVENTION

The improved hinge construction of the present invention supports a side door on a bin that is adapted for transporting and storing bulk material. The hinge construction consists of an extruded hinge bar having an upper hollow portion that is mounted to the side wall above the discharge opening and lower front and back flange portions extending downwardly from the upper portion. Hinge ends are secured to opposite ends of the hinge bar and are provided with support pins on which the door is hung. Each pin is horizontally disposed and diametrically opposed to the other pin member. Both pins are located below the upper portion of the hinge bar and between the front and back flange portions. The door is provided along its upper end with an integrally formed inverted U-shaped section which engages the pin members to thus provide for up and down pivotal support of the door on the hinge bar.

Because the pins are located only at the ends of the hinge bar and because they are circular and extend laterally from the hinge ends, an accumulation of foreign matter between the hinge and the door is effectively avoided. The upper hinge bar portion and the front and back flange portions operate to shield the pin members and the U-shaped upper section of the door from the accumulation of matter that would hamper the operation of the door and the hinge. The hinge bar further acts as a bumper protecting the closed door from being dislodged from the discharge opening during rough handling of the bin. In addition, the hinge construction of the present invention enables the door to be easily removed from the pin members by merely raising it above the horizontal to disengage the U-shaped section of the door from the pin members.

Further objects, features and advantages of the present invention will become apparent from a consideration of the following description, when taken in connection with the appended claims and the accompanying drawing in which:

Figure 1:
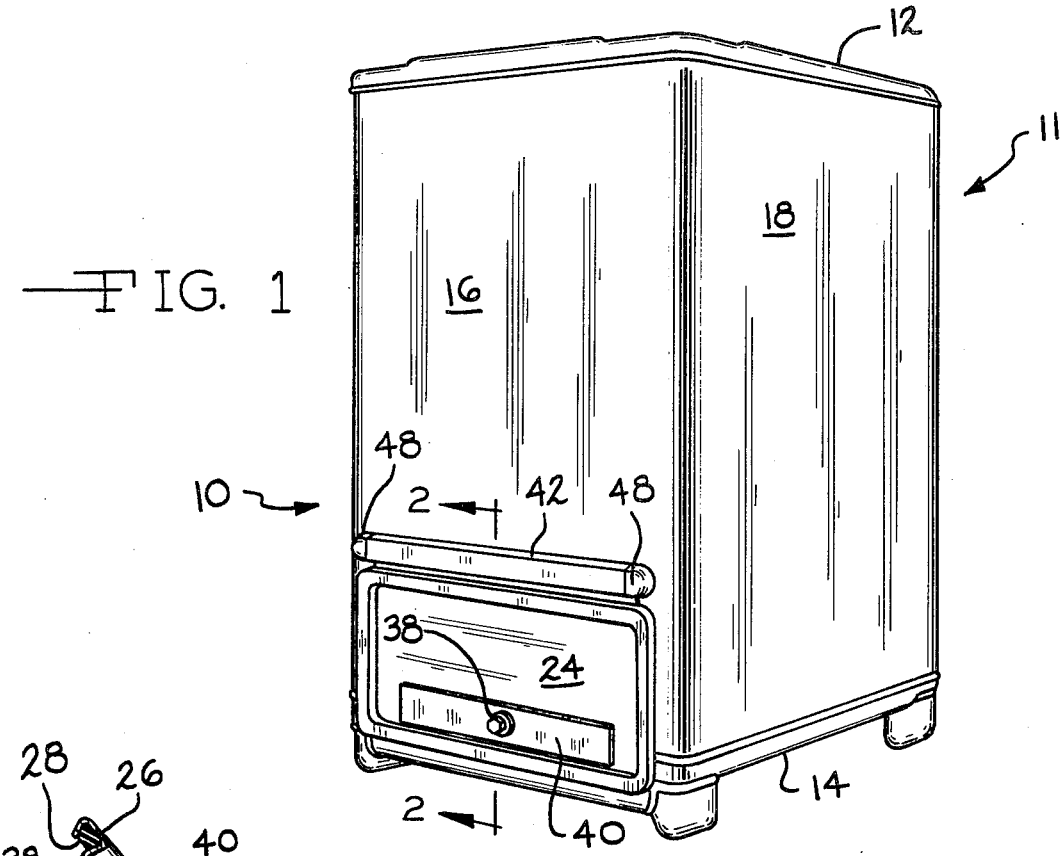
FIG. 1 is a perspective view of a bin incorporating the improved hinge construction of the present invention.
Figure 2:
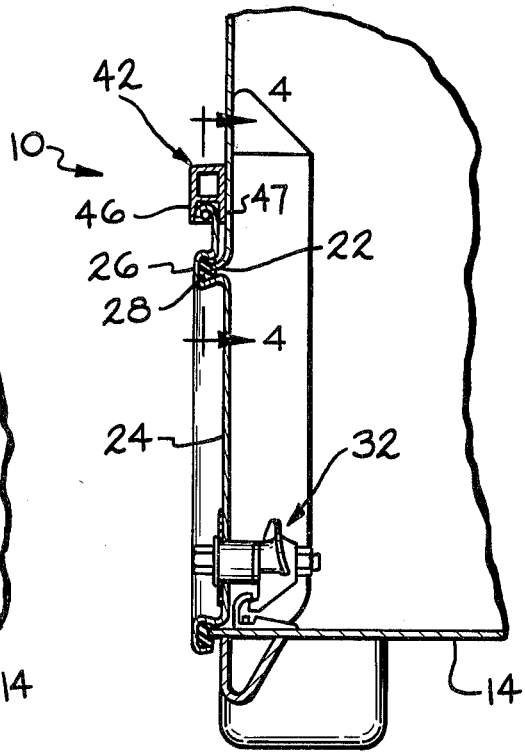
FIG. 2 is a sectional view of the door and hinge construction taken substantially from line 2—2 in FIG. 1.
Figure 4:
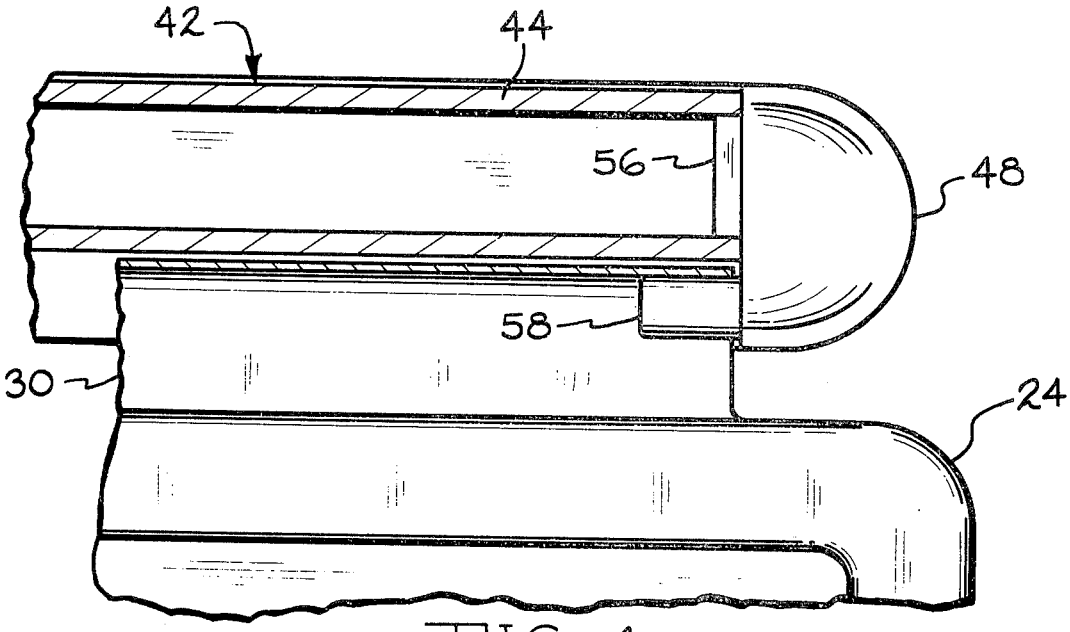
FIG. 4 is an enlarged fragmentary sectional view of the hinge construction of the present invention taken substantially from line 4—4 in FIG. 2.
Figure 7:
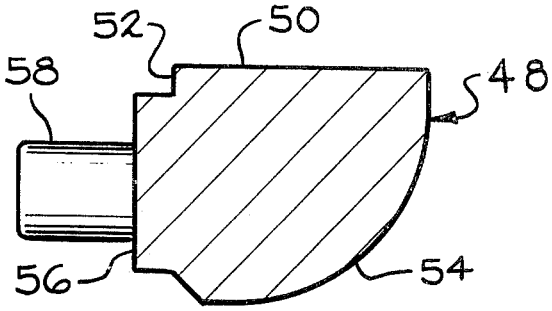
FIG. 7 is a sectional view of the hinge end taken substantially from line 7—7 in FIG. 5.
Figure 8:
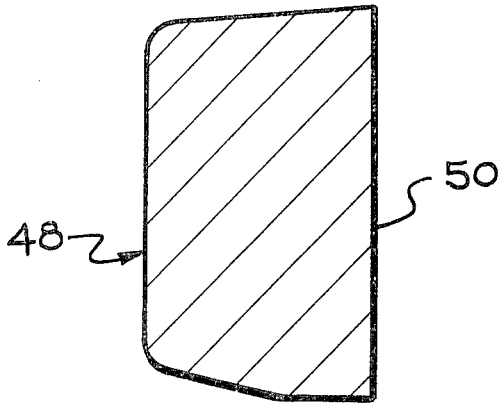
FIG. 8 is a sectional view of the hinge end taken substantially from the line 8—8 in FIG. 5.
Figure 6:
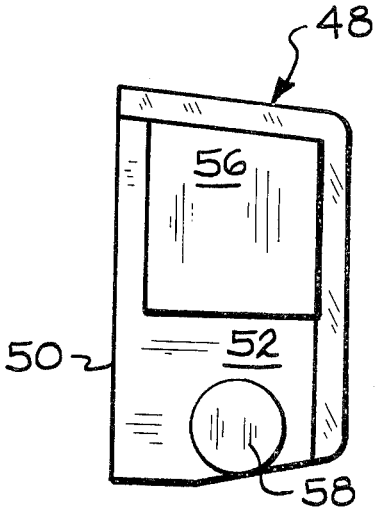
FIG. 6 is a side elevational view of the hinge end of the present invention.
Figure 5:
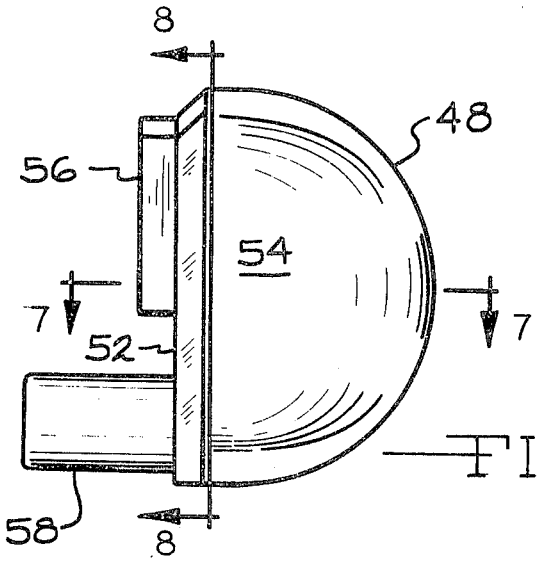
FIG. 5 is an elevational view of the hinge end of the present invention.

Referring to the drawings, the improved hinge construction of the present invention, shown generally at 10 in FIG. 1, is incorporated in a bin 11 suitable for transporting and storing bulk material. The bin 11 consists of a top wall 12, a bottom wall 14 and vertical side walls 16 and 18 (only two vertical side walls being shown). An opening (not shown) is provided in the top wall 12 through which bulk material is deposited in the bin 11. A discharge opening 20 (FIG. 3) formed to a generally rectangular configuration is located in one side wall 16 adjacent the bottom wall 14. A horizontally extending flange 22 encircles the discharge opening 20 and the sides and top portions of the flange 22 are formed by bending the side wall outwardly at the opening 20. The bottom portion of the flange 22 constitutes an integral extension of the bottom wall 14. A generally rectangular side door 24, shown in FIGS. 1 and 2, is provided with a channel 26 in which gasket material 28 is retained. The channel 26 is rectangular conforming substantially to the flange 22 so that when the door 26 is closed the flange 22 is embedded in the gasket material 28. An inverted U-shaped section 30 curves outwardly from the door 24 along its upper edge to provide for pivotal engagement of the door 24 with the hinge 10.

A latch assembly 32 of the type that is described in detail in U.S. Pat. 3,567,263 is provided for releasably maintaining the door 24 in a closed position, when desired. The latch assembly 32 consists of a latch plate 34 secured to the bottom 14 and latch cam 36 rotatably supported in the spindle assembly 38 that extends through the door 24 and through a reinforcing plate 40 secured to the front side of the door 24. In response to manipulation of the spindle assembly 38 so as to first engage the cam 36 with the plate 34 and subsequently rotate the cam 36 in tighter engagement with the plate 34, an inwardly directed force is applied to the bin door 24 and will move the gasket 28 into sealing engagement with the flange 22 so that the flange 22 is actually embedded in the gasket 28, as shown in FIG. 2. The location of the closing force within the confines of the channel 26, and substantially centrally between the sides of the opening 20, provides necessary horizontally inwardly directed forces on the gasket 28 to provide for its sealing engagement with the flange 22.

Figure 3:
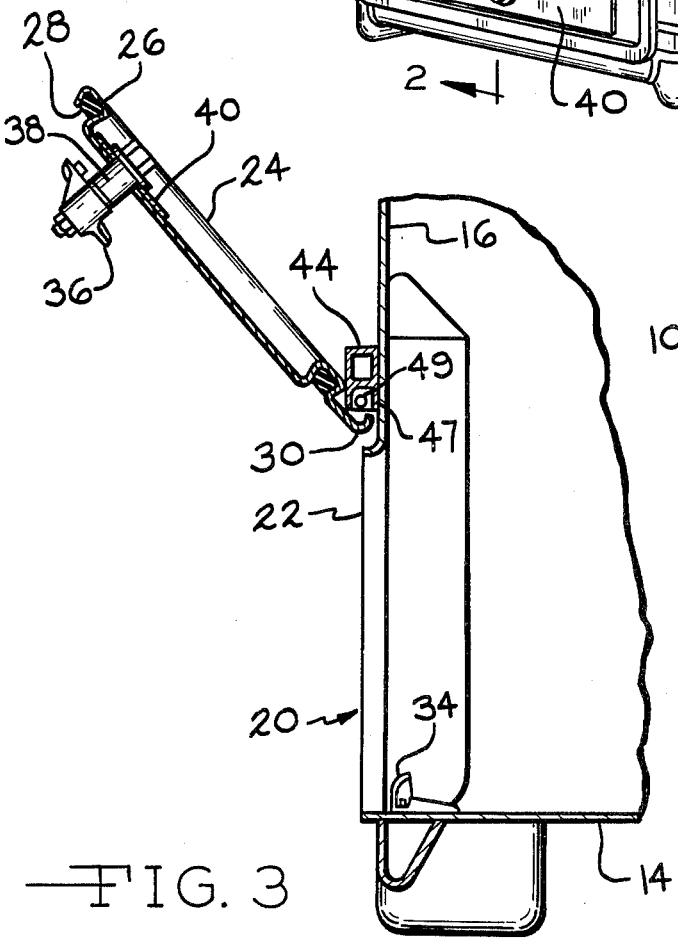
FIG. 3 is a sectional view similar to FIG. 2 but showing the door disengaged from the bin.

The hinge 10 of the present invention consists of a hinge bar 42 horizontally secured to the side wall 16 at a position above the discharge opening 20 as shown in FIGS. 2 and 3. The hinge bar 42 includes an upper rectangular hollow portion 44, a lower front flange or skirt portion 46 and a lower back flange or skirt portion 47 that is positoned adjacent the wall 16. The horizontally disposed hinge bar 42 has secured to the ends thereof hinge end body members 48 that are identical and are provided with support portions on which the door is hung. In addition to retaining the body members 48, the hinge bar 42 serves as a bumper to deflect collisions that can occur during handling of the bin 11 thus protecting the door 24 in its closed position to insure that a dust-tight seal is maintained. The lower front and back skirts 46 and 47 and the upper portion 44 also serve to prevent dirt and other matter from being lodged between the U-shaped section 30 of the door 24 and the support portions of the hinge ends 48.

Each body member 48 (FIGS. 5–8) includes a flat back wall 50 and a shoulder located at a right angle to the back wall 50. A rounded end surface 54 on the body member functions primarily to deflect collisions away from the hinge 10. A projection 56 is provided on the hinge side wall 52 and corresponds generally to the cross-sectional hollow configuration of the upper portion 44 of the hinge bar 42 so that it can be frictionally telescoped within the hollow upper portion 44 and secured in place by any suitable means as welding. When the hinge body members 48 are secured to the hinge bar 42, the back wall 50 of each body member 48 is in a face to face abutting relation with the side wall 16, thereby forming an integral unit with the hinge bar 42 that is secured to the side wall 16.

A pin member 58 having circular cross-section is integrally formed with and extends horizontally from each body member 48 in a parallel relation with the projection 56. The pin member 58 is positoned below the upper portion 44 of the hinge bar 42 and between the front and back skirt portions 46 and 47 of the hinge bar 42. The positioning of the pin member 58 provides a suspended hinge connection in which a gap 49 is formed between the hinge pin member 58 and the skirts 46 and 47 and the upper portion 44 of the hinge bar 42. The gap 49 forms a clearance in which the U-shaped section 30 of the door 24 is disposed. The pin members 58 extend outwardly from the hinge end 48 a distance sufficient to provide structural strength in supporting the door 24. Because the pin members 58 are relatively short and do not extend the length of the U-shaped section 30, only a small bearing surface is provided thus avoiding any accumulation of dirt along the entire length of the hinge 10.

As seen in FIG. 3, the door 24 can be easily removed from the bin 11. By pivoting the door 24 above the horizontal, the U-shaped portion 30 can be disengaged from the hinge ends 48 by moving the door 24 downwardly away from the hinge ends 48. The door 24 and the hinge 10 can then be easily cleaned prior to further use of the bin 11.

The above description discloses an improved hinge construction in which horizontally disposed pin members 58 engage the U-shaped section 30 of the door 24 to provide for the pivotal movement of the door 24 on the side wall 16 of the bin 11. The door 24 can easily be attached and removed from the hinge 10. In addition to supporting the door 24, the hinge bar 42 and the body members 48 shield the hinge connections from dirt and serve as a bumper, deflecting any impacts during handling of the bin 11.

What is claimed:

1. In a bin for storing and transporting bulk material and having a top wall, vertical side walls, a horizontal bottom wall, a discharge opening in one of said side walls and a door mounted on said one side wall for movement to a closed position overlying said opening, the improvement comprising hinge means mounted on said one side wall at a position above said discharge opening for hingedly mounting said door on said bin, said hinge means comprising a hinge bar mounted on said one side wall in a generally horizontally extending position above said opening, said bar having a pair of horizontally spaced ends, substantially horizontally aligned door support pins mounted on said bar ends and positioned therebelow so that said pins extend toward each other and terminate in a horizontally spaced relation, said door having inverted U-shaped sections on the upper end thereof rotatably supported on said pins.

2. A bin according to claim 1 wherein said hinge bar is hollow and further including body members formed integral with said hinge pins and interfitted with said hinge bar ends so that said body members are supported on said hinge bar.

3. A bin according to claim 2 wherein each said body member has a projection which extends into one end of said hinge bar in tight interfitting relation therewith.

4. A bin according to claim 3 wherein each body member has a back wall and a rounded end, said hinge pin and projection extending away from said rounded end in the same direction, said back wall being positoned in a face to face relation with said one bin side wall, said pin extending from said rounded end in a position generally parallel to said one side wall of said bin.

5. A bin according to claim 4 wherein said hinge bar has a downwardly extending flange disposed in spaced relation with said one bin side wall, said hinge pins being positioned in spaced relation below said hinge bar and between said flange and said one side wall.

* * * * *